US010195516B2

(12) United States Patent
Sakakibara

(10) Patent No.: US 10,195,516 B2
(45) Date of Patent: Feb. 5, 2019

(54) FIGHTING SPORTS RING EQUIPMENT

(71) Applicant: Dream Factory Worldwide Co., Ltd., Tokyo (JP)

(72) Inventor: Nobuyuki Sakakibara, Tokyo (JP)

(73) Assignee: DREAM FACTORY WORLDWIDE CO., LTD., Tokyo (JP)

( * ) Notice: Subject to any disclaimer, the term of this patent is extended or adjusted under 35 U.S.C. 154(b) by 0 days.

(21) Appl. No.: 15/389,099

(22) Filed: Dec. 22, 2016

(65) Prior Publication Data

US 2017/0182399 A1 Jun. 29, 2017

(30) Foreign Application Priority Data

Dec. 28, 2015 (JP) ..... 2015-256642

(51) Int. Cl.

| | |
|---|---|
| ***A63C 19/00*** | (2006.01) |
| ***F21S 4/26*** | (2016.01) |
| *A63G 9/00* | (2006.01) |
| *F21Y 115/10* | (2016.01) |
| *F21Y 103/10* | (2016.01) |
| *F21W 131/40* | (2006.01) |

(52) U.S. Cl.

CPC ..... *A63C 19/005* (2013.01); *F21S 4/26* (2016.01); *A63C 2203/14* (2013.01); *F21W 2131/40* (2013.01); *F21Y 2103/10* (2016.08); *F21Y 2115/10* (2016.08)

(58) Field of Classification Search

CPC ..... A63C 19/00; A63C 19/005; A63H 3/00; A63H 3/52; A63G 9/00; A63G 9/004; A45B 3/00; A45B 3/04

USPC ..... 472/92–94, 118; 362/84

See application file for complete search history.

(56) References Cited

U.S. PATENT DOCUMENTS

| | | | | |
|---|---|---|---|---|
| 485,896 | A * | 11/1892 | Sterry, Jr. | A63C 19/005 472/93 |
| 4,776,585 | A * | 10/1988 | Maleyko | A63B 5/20 200/11 G |
| 5,116,045 | A * | 5/1992 | Jahoda | A63B 69/004 472/92 |
| 6,340,334 | B1 * | 1/2002 | Olsen | A63C 19/005 472/92 |
| 2005/0162850 | A1 * | 7/2005 | Luk | H05B 33/0857 362/227 |
| 2006/0217211 | A1 * | 9/2006 | Cadotte, Jr. | A63G 9/00 472/118 |

(Continued)

FOREIGN PATENT DOCUMENTS

JP 3009589 U 4/1995

*Primary Examiner* — Kien Nguyen

(74) *Attorney, Agent, or Firm* — Alleman Hall Creasman & Tuttle LLP

(57) ABSTRACT

Provided is ring equipment made on the basis of an idea going beyond conventional knowledge, which is capable, not only of enhancing the mood of spectators and further creating feeling of high tension and interest of a match, but of making it possible for players to effectively use the ring equipment for the handling of the match, or the like, thereby making the match richer in content. A rope strung between corner posts includes a rope body having translucency and a light emitting member buried in the rope body. The ring equipment is configured so that light from the light emitting member is passed through the rope body and emitted outward in the radial direction of the rope body.

10 Claims, 4 Drawing Sheets

(56) References Cited

U.S. PATENT DOCUMENTS

2008/0266833 A1* 10/2008 Thomas ..... A45B 3/04
362/84

* cited by examiner

FIGHTING SPORTS RING EQUIPMENT

BACKGROUND OF THE INVENTION

Field of the Invention

The present invention relates to fighting sports ring equipment and the like, which are used, for example, for mixed martial arts and professional wrestling.

Background Art

For the purpose of mixed martial arts, professional wrestling, and boxing, a ring is formed by forming a square mat (canvas) by laying a cushion or the like on a base, then respectively disposing corner posts at corners of the mat, and stringing a plurality of ropes between the corner posts, as disclosed in Patent Document 1.

As a rope used for this type of ring, a rope is known in which the periphery of copper wire is covered with a rubber tube, besides ones whose material is, for example, cotton, hemp, or nylon.

In recent years, industrial enterprise has been performed in a large scale venue with recent equipment. Therefore, the venue has been designed to make the content of a match more understandable by enhancing the mood of spectators with the use of acoustics and lighting, and by showing a match video from various angles or showing a regenerated video through a plurality of large displays.

Although these various improvements have been made around the ring, the ring itself is old fashioned. The fact is that only advertisements and designs are added onto the mat (canvas) correspondingly to camera images from above.

A very strange ring with barbed wire wound therearound and explosives arranged therearound has certainly been proposed as disclosed in Patent Document 1. This is not intended for spectators to enjoy the content of the match but rather intended for spectators to enjoy an unexpected event happening during the match due to the ring equipment.

PRIOR ART DOCUMENT

Patent Document

Patent Document 1: Utility Model Registration No. 3009589

SUMMARY OF THE INVENTION

Problems to be Solved by the Invention

The present invention has been made in view of the above issues, and has an object to provide ring equipment made on the basis of an idea going beyond conventional knowledge which is capable not only of enhancing the mood of the spectators and further creating a feeling of excitement and interest in a match, or the like, but of making it possible for players to effectively use the ring equipment for the handling of the match, thereby making the match richer in content.

Means of Solving the Problems

Specifically, a fighting sports ring equipment according to the present invention includes a rope strung between corner posts. The rope includes a string-shaped rope body having translucency and a light emitting member buried in the rope body. The fighting sports ring equipment is configured so that light from the light emitting member is passed through the rope body and then emitted outward in a radial direction of the rope body.

An elastic resin tube having translucency is preferably used as the rope body in order to facilitate extraction and removal operations for insertion, replacement, or the like of the light emitting member, and in order to suitably protect the light emitting member buried in the rope body from impact due to, for example, the fact that the players come into contact with the rope.

The elastic resin tube is preferably composed of a semi-transparent resin having light diffusion properties in order to ensure that the rope itself shines evenly in any view from any direction in the radial direction.

As a specific embodiment of the light emitting member, there is one which includes a band-shaped flexible board and a plurality of LEDs disposed on the flexible board in a row shape along a longitudinal direction of the flexible board. This facilitates manufacturing and ensures safety because sufficient brightness is obtainable through driving by a low-voltage. It is therefore possible to prevent occurrence of unforeseeable circumstances, such as electrification shock.

In order to prevent disconnection or the like by protecting the light emitting member from impact during a match, and in order to facilitate replacement of the light emitting member, it is more preferable that the light emitting member is inserted into a second tube composed of a transparent elastic resin, and the second tube with the light emitting member inserted therein is inserted into the elastic resin tube.

With an embodiment configured so that apron plates respectively hung down from end sides of the mat-canvas hang down so as to spread obliquely downward and a surface of each of the apron plates is inclined, the ring itself that is formed by being surrounded by the rope is recognized by spectators as being large and stable, and the spectators can see an apron very well. Hence, further effects, such as enhancement of the mood of the match, are produced by adding advertisements and designs to a surface of the apron with the use of print and LEDs.

Effects of the Invention

The present invention so configured has been made on the basis of the idea going beyond conventional knowledge that the rope subjected to impact is configured to emit light.

With the present invention, the ring itself can create the atmosphere as a battlefield by causing the rope to emit light in a desired mode. Enhanced expectation and excitement not only make it possible for the spectators to enjoy the match more, but also exert a favorable influence upon the players. Consequently, the match that is richer in content can be expected.

DESCRIPTION OF THE EMBODIMENTS

Fighting sports ring equipment 100 (hereinafter usually referred to simply as "ring equipment") according to an embodiment of the present invention is described below with reference to the drawings.

Figure 1:
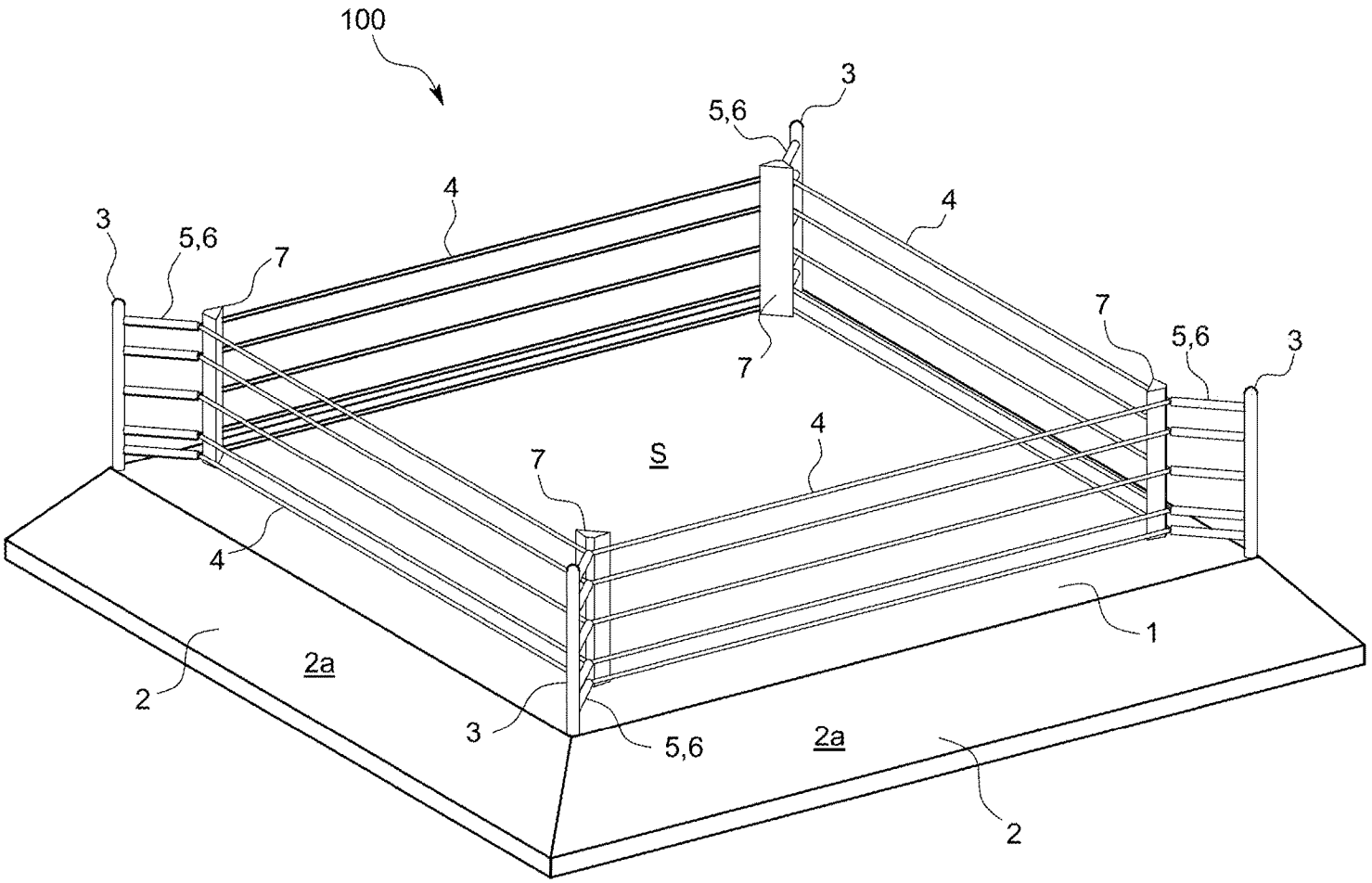
FIG. 1 is a general view of a ring equipment according to an embodiment of the present invention.

As shown in FIG. 1, the ring equipment 100 of the present embodiment is made up of a base (not shown) formed by combining metal frames (not shown) into a frame shape, a floor plate 1 that is laid on the base and constitutes a square mat-canvas S, apron plates 2 respectively hung downward from edges of the floor plate 1, corner posts 3 respectively disposed vertically at four corners of the mat-canvas S, and a plurality of (for example, five) ropes 4 strung between the corner posts 3 adjacent to each other so that the ropes 4 are wound around different upper and lower portions of the corner posts 3.

The floor plate 1 has a structure made up of a plurality of layers obtained by stacking a plurality of plate members. The floor plate 1 is formed by stacking, for example, a hard base plate, an elastic joint mat, a resin soft mat, and a skin sheet in this order from bottom to top.

The corner posts 3 are columns made of metal (for example, iron) which are vertically extended with their respective lower end portions secured to the base.

Figure 2:
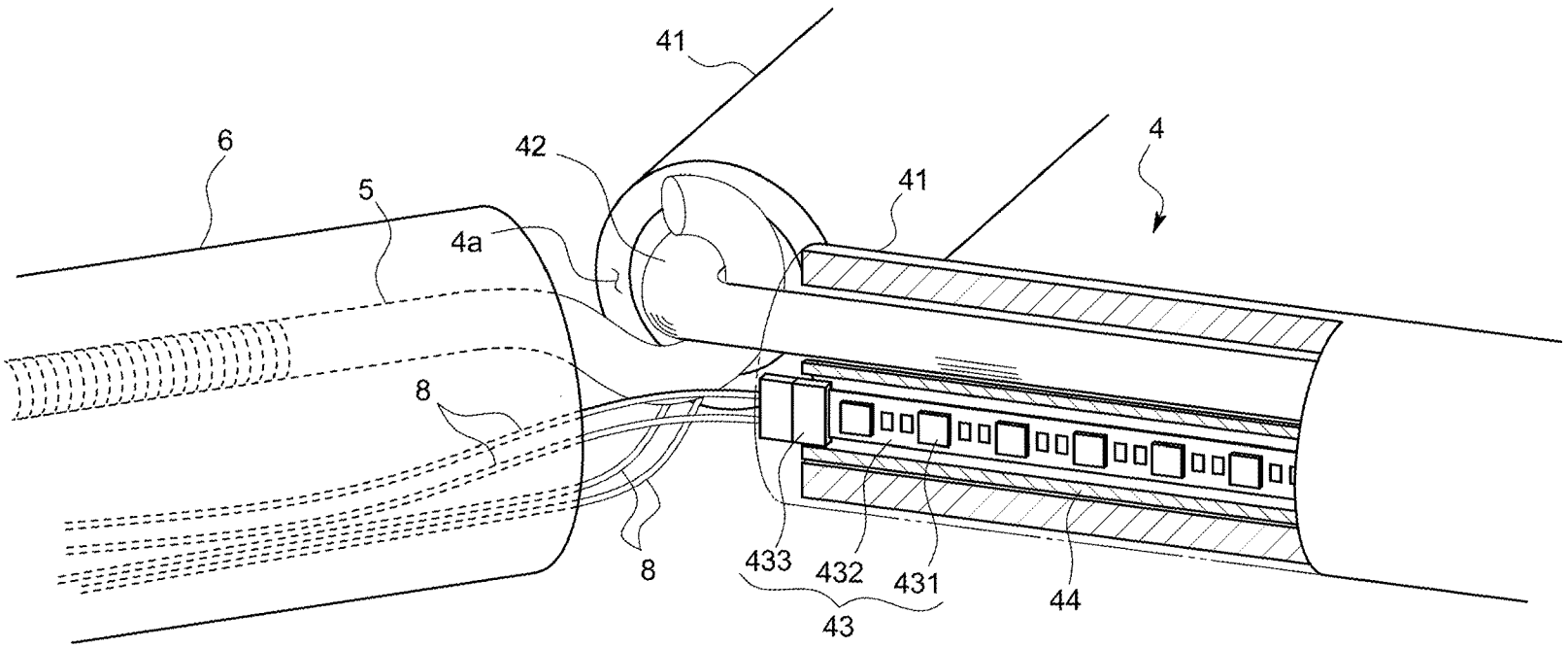
FIG. 2 is a partial longitudinal sectional perspective view that shows a structure of a rope in the embodiment.
Figure 3:
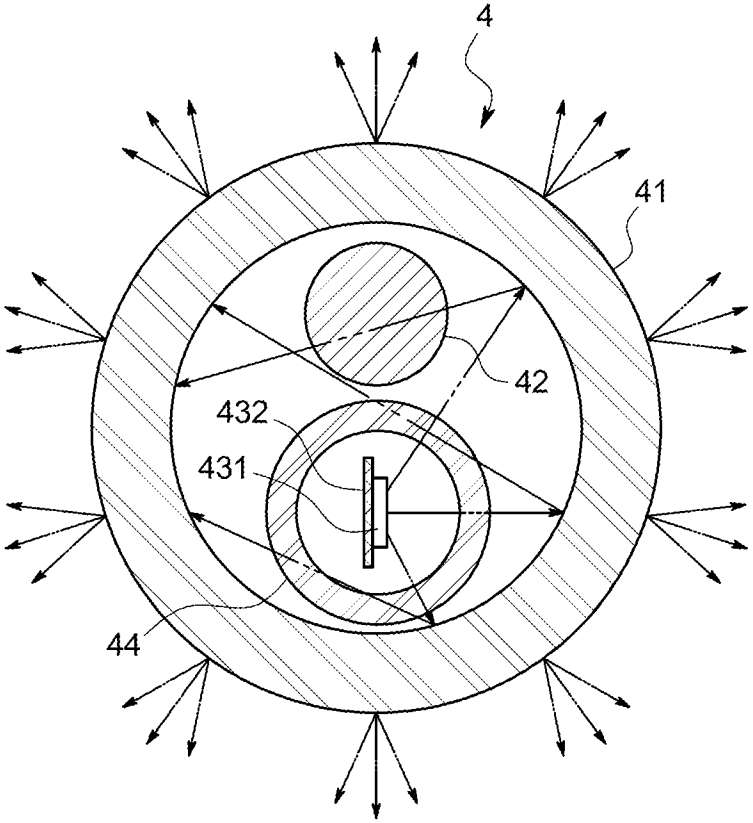
FIG. 3 is a cross sectional view of the rope in the embodiment.

As shown in FIGS. 2 and 3, each of the ropes 4 forms an annular shape and includes an elastic resin tube or main tube 41 (hereinafter usually referred to as "rope body 41"), and a metal steel wire 42 that is a core inserted into the rope body 41. The rope 4 is secured through a rope connection fitting 5 (hereinafter usually referred to as "turnbuckle 5") to the corner posts 3. The ring is formed inside the annular shaped rope.

More specifically, one end of the turnbuckle 5 is secured to a surface of each of the corner posts 3 which faces a middle part of the ring. As shown in FIG. 2, a locking portion 4*a* configured to divide the rope body 41 and expose the metal steel wire 42 is disposed at four locations of the rope 4. The other end of the turnbuckle 5 is hooked on the metal steel wire 42 being exposed from the locking portion 4*a*. By fastening of the turnbuckle 5, the rope 4 is stretched tightly toward the corner posts 3 and formed into a square shape in a plan view so that the ring is formed inside the square shape.

Further in the present embodiment, a width of the mat-canvas S extending outside each of the ropes 4 (a width on an apron side) is made slightly larger than that of conventional ones so that it is easier for a ring girl or the like to walk there.

The turnbuckle 5 is covered with an elastic resin protective tube 6 for the purpose of preventing dangers. In FIG. 1, reference numeral 7 indicates a corner mat.

The ring equipment 100 of the present embodiment has the following characteristic features.

A first characteristic feature exists in the ropes 4.

The rope body 41 of each of the ropes 4 in the present embodiment is not a conventional opaque one but is composed of a semitransparent material that diffuses and transmits light.

The rope 4 further includes a line-shaped light emitting member 43 inserted into the interior of the rope body 41 as shown in FIGS. 2 and 3.

The light emitting member 43 includes a band-shaped flexible wiring board 432, a plurality of surface-mount LEDs 431 mounted in one or a plurality of rows along a longitudinal direction of the flexible wiring board 432, and a connector 433 disposed at an end part of the flexible wiring board 432. The light emitting member 43 is inserted into the transparent or semitransparent second tube 44. The second tube 44 with the light emitting member 43 inserted therein is inserted side by side with the metal steel wire 42 into the rope body 41.

Luminescent colors of the LEDs 431 may be the same or different. Alternatively, two or more second tubes 44 with the light emitting member 43 inserted therein may be inserted into the rope body 41. In this case, the light emitting members 43 may differ from each other in luminescent color.

A power source line 8 is connected to the connector 433 as shown in FIG. 2. The power source line 8 is passed through the protective tube 6 that protects the turnbuckle 5, and is then hung down from the corner post 3 and connected to a power source controller (not shown) lying ahead thereof.

The power source controller is an electric circuit configured to supply power to the LEDs 431 by an operation of an operator or automatically to cause the LEDs 431 to emit light in a predetermined mode, namely, cause part or all of the LEDs 431 to light up or blink at a predetermined brightness and a predetermined color. The power source controller is disposed at a location of a ringside at which it is easy to operate. Alternatively, the power source controller may be disposed at the same location as operating devices for venue acoustics and lighting, and may be configured to be connected thereto by wired or wireless connections so as to enable synchronous operation.

With the foregoing configuration, when the LEDs 431 of the light emitting member 43 emit light upon receipt of a command from the power source controller, the light passes through the second tube 44 and abuts the rope body 41, and the light is then diffused therein and emitted outward. Consequently, the ropes 4 looks as if the whole of the ropes 4 in the radial direction thereof shines.

Accordingly, the present embodiment produces the following effects.

For example, by causing the ropes 4 to emit light in a desired mode in synchronization with circumferential lighting and acoustics during a match and before the match, it is possible to cause the ring itself to create an atmosphere as a kind of fantastic and noble fighting field.

This not only enhances expectation and excitement of the spectators but also has a good influence on the players, thereby making it possible to expect the match that is richer in content.

It is also possible to enhance expectation and realistic sensation of the spectators by, for example, configuring so that the luminescent color of the ropes 4 changes correspondingly to the remaining time of a round (for example, initially blue lighting, red lighting when the remaining time of the round is less than one minute, and red flickering when the remaining time is less than 30 seconds and then a gradual increase in flickering speed). This is naturally seen by the players, thus making it possible to develop their own strategy taking the progress of the match into consideration. This configuration may be achieved in the following manner that the power source controller automatically controls the LEDs by a timer, or an operator manually operates the power source controller. When the mat-canvas S is illuminated with various colors by way of lighting or the like, the light of a light source can enter the eyes of the players during the match, thus being obstructive to the match. However, the light emission from the ropes 4, which is the diffuse light in the present embodiment, is not liable to bother the players.

When a referee warns the player who has broken a rule, or urges the players to be aggressive in a deadlock state, it is possible to indicate this situation by light emitting modes of the ropes 4. For example, the ropes 4 emit red light when taking off points, the ropes 4 emit yellow light when issuing a warning, and the ropes 4 blink different colors in the deadlock state. In these cases, the power source controller may be configured to operate under a command from the referee or an out-of-the-ring judge.

Alternatively, in order to detect impact when the players abut against the ropes 4 or the floor plate 1, pressure-sensitive sensors may be disposed in the ropes 4 and the floor plate 1 so that the ropes 4 automatically emit light of color and brightness according to, for example, an impact force.

Still alternatively, various light emitting modes are applicable to the ropes 4.

A second characteristic feature exists in the apron plates 2. As shown in FIG. 1, the apron plates 2 are respectively hung down obliquely from the end sides of the floor plate 1. A surface of each of the apron plates 2 has an inclined surface 2*a*. Advertisements and designs are added to the inclined surface 2*a* by using LEDs and print.

Although conventional aprons are hung down vertically, the above configuration provides a good view of the apron from the spectators because the recent venue equipment, such as a dome venue, is often configured so that the spectators watch the match obliquely from above. Additionally, the ring itself is recognized as being large and stable. Similarly to the ropes 4, the effect that the ring itself enhances the mood of the match is producible by applying decorative illuminations and print designs to the apron.

The present invention is not limited to the above embodiment.

Figure 4:
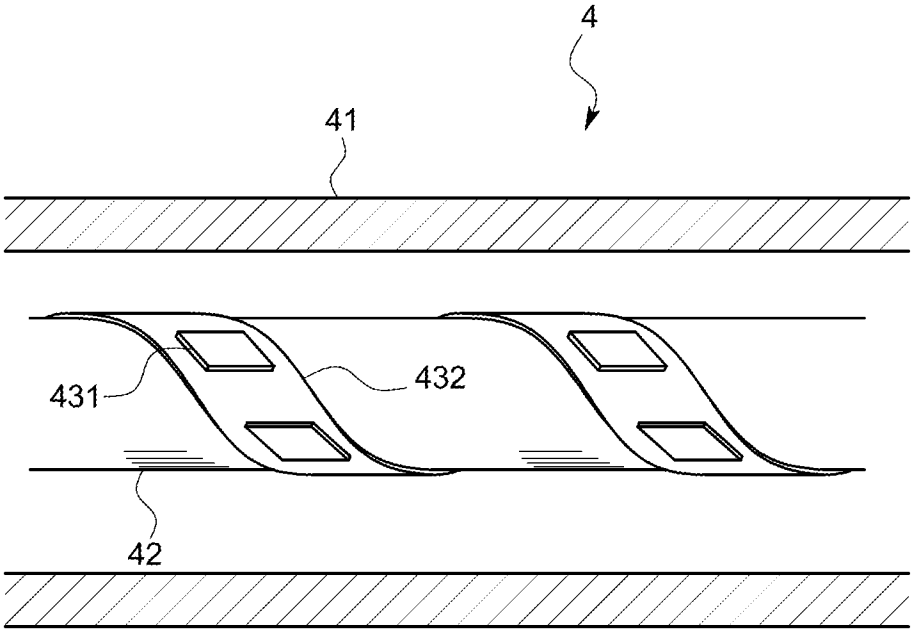
FIG. 4 is a side view that shows a state in which a light emitting member is wound around a metal steel wire in another embodiment of the present invention.

For example, the foregoing band-shaped light emitting member 43 may be inserted into the rope body 41 while being wound around the metal steel wire 42 as shown in FIG. 4. This case eliminates the need for the second tube 44, and costs can be reduced accordingly. This case is capable of producing effects similar to the above embodiment though being slightly inferior to the case of inserting the light emitting member into the second tube 44 as in the above embodiment in terms of work efficiency of attachment, detachment, and replacement, as well as durability.

The light emitting member may be one in which a plurality of LEDs are connected to one another via a cable, besides one which uses the flexible board. It is possible to use light emitting elements other than LEDs.

The rope may be one in which a light emitting member, such as an LED, is integrally buried in a resin rope body that is solid and has translucency, without using any tube.

It is possible to cause the floor plate to emit light. This case may include, for example, the following configuration in which a bottomed groove and a bottomed hole are disposed on a hard base plate, LEDs are respectively inserted into the groove and hole, and a transparent or semitransparent elastic resin mat is laid thereon.

It will be understood that the present invention is not limited to the above-described embodiment, and various modifications may be made therein without departing from the spirit and scope of the present invention.

DESCRIPTION OF REFERENCE CHARACTERS

100: fighting sports ring equipment
2: apron plate
3: corner post
4: rope
41: rope body (tube)
43: light emitting member
431: LED
432: flexible board
44: second tube
S: mat-canvas

What is claimed is:

1. A fighting sports ring equipment comprising a rope strung between corner posts, the rope comprising an elastic rope body having translucency and a light emitting band buried in the rope body, and a metal wire passing through the elastic rope body, wherein the fighting sports ring equipment is configured so that light from the light emitting band is passed through the rope body and emitted outward in a radial direction of the rope body, and wherein the light emitting band is configured to be wound around the metal wire inside the rope body.

2. The fighting sports ring equipment according to claim 1, wherein the rope body is an elastic resin tube having translucency.

3. The fighting sports ring equipment according to claim 2, wherein the elastic resin tube is composed of a semitransparent resin having light diffusion properties.

4. The fighting sports ring equipment according to claim 2, wherein the light emitting band is inserted into a second tube composed of a transparent elastic resin, and the second tube with the light emitting band inserted therein is inserted into the elastic resin tube.

5. The fighting sports ring equipment according to claim 1, wherein the light emitting band comprises a band-shaped flexible board and a plurality of LEDs disposed on the flexible board in a row shape along a longitudinal direction of the flexible board.

6. The fighting sports ring equipment according to claim 1, wherein an apron plate hung down from an end side of a mat-canvas on which players have a match is hung down so as to spread obliquely downward, and a surface of the apron plate is configured to be inclined.

7. The fighting sports ring equipment according to claim 6, wherein an illumination from the light emitting band buried in the rope body illuminates the surface of the apron plate, the illumination on the surface of the apron plate including at least one selected from the group consisting of words, letters, symbols, patterns, and designs.

8. The fighting sports ring equipment of claim 1, wherein when the rope is flexed due to an impact between a ring occupant and the rope between the corner posts, the metal wire is stretched and subject to tension forces from the impact while the light emitting band is not subject to tension forces because an angle of the winding is free to change in order to accommodate stretching of the metal wire from the impact.

9. A method for operating a fighting sports ring equipment comprising rope strung between corner posts, the rope comprising an elastic rope body having translucency and a light emitting band buried in the rope body, and a metal wire passing through the elastic rope body, the method comprising causing the light emitting band to emit light during a match, wherein the light emitting band is configured to be wound around the metal wire inside the rope body.

10. A fighting sports ring equipment comprising a rope strung between corner posts, the rope comprising an elastic rope body having translucency and a light emitting band buried in the rope body, and a controller electrically coupled to the light emitting band, wherein the fighting sports ring equipment is configured so that light from the light emitting band is passed through the rope body and emitted outward in a radial direction of the rope body, wherein at least one pressure-sensitive sensor is disposed in the rope, and wherein a light emission from the rope is controlled by the controller to emit light with at least one of a color or brightness that is determined according to an impact force sensed by the pressure-sensitive sensor.

* * * * *